US011134781B2

(12) United States Patent
Robinson

(10) Patent No.: US 11,134,781 B2
(45) Date of Patent: Oct. 5, 2021

(54) FRAME STRUCTURE AND ASSEMBLY METHOD FOR MOTION FURNITURE

(71) Applicant: Ashley Furniture Industries, Inc., Arcadia, WI (US)

(72) Inventor: Jeremy Robinson, Pontotoc, MS (US)

(73) Assignee: Ashley Furniture Industries, Inc., Arcadia, WI (US)

( * ) Notice: Subject to any disclaimer, the term of this patent is extended or adjusted under 35 U.S.C. 154(b) by 0 days.

(21) Appl. No.: 15/676,837

(22) Filed: Aug. 14, 2017

(65) Prior Publication Data

US 2019/0045926 A1 Feb. 14, 2019

(51) Int. Cl.

| | |
|---|---|
| ***A47C 1/03*** | (2006.01) |
| ***A47C 1/02*** | (2006.01) |
| ***A47C 1/0355*** | (2013.01) |
| ***A47C 7/35*** | (2006.01) |
| ***A47C 7/38*** | (2006.01) |

(52) U.S. Cl.
CPC ..... *A47C 1/0355* (2013.01); *A47C 1/02* (2013.01); *A47C 7/35* (2013.01); *A47C 7/38* (2013.01)

(58) Field of Classification Search
CPC ..... A47C 1/02; A47C 1/0355; A47C 7/02
See application file for complete search history.

(56) References Cited

U.S. PATENT DOCUMENTS 4,365,836 A * 12/1982 Jackson ..... A47C 1/03211 297/330
6,893,085 B2 5/2005 LaPointe et al.
6,896,323 B2 5/2005 LaPointe et al.
(Continued)

FOREIGN PATENT DOCUMENTS

CN 103565157 A 2/2014
CN 203458064 U 3/2014
(Continued)

OTHER PUBLICATIONS

PCT International Search Report for PCT App. No. PCT/US2018/046546 dated Nov. 29, 2018, 11 pages.
PCT International Search Report for PCT App. No. PCT/US2018/046731 dated Nov. 29, 2018, 15 pages.
(Continued)

*Primary Examiner* — Ryan D Kwiecinski
(74) *Attorney, Agent, or Firm* — Waller Lansden Dortch & Davis, LLP; Matthew C. Cox

(57) ABSTRACT

A frame for motion furniture includes a first side frame and a second side frame. A first plurality of connecting flanges extends from the first side frame toward the second side frame, and a second plurality of connecting flanges extends from the second side frame toward the first side frame. A plurality of cross support members span between the first and second side frames in a horizontal direction, each of the cross support members positioned against a corresponding connection flange of the first plurality of connection flanges and against a corresponding connection flange of the second plurality of connection flanges. A plurality of fasteners connects corresponding cross support members to corresponding connection flanges. Each fastener has a longitudinal axis that is oriented in a direction that is transverse to the horizontal direction. A method of assembling furniture having the disclosed cross support connection structure is provided.

6 Claims, 9 Drawing Sheets

(56) References Cited

U.S. PATENT DOCUMENTS

| | | | | |
|---|---|---|---|---|
| 7,699,394 | B2 | 4/2010 | Humer et al. | |
| 7,997,644 | B2 | 8/2011 | Hoffman et al. | |
| 8,016,348 | B2 | 9/2011 | Hoffman et al. | |
| 8,113,574 | B2 | 2/2012 | Hoffman et al. | |
| 8,297,693 | B2 | 10/2012 | Hoffman et al. | |
| 8,366,188 | B2 | 2/2013 | Adams et al. | |
| 8,398,165 | B2 | 3/2013 | Lawson | |
| 8,398,168 | B2 * | 3/2013 | Lawson | A47C 1/0355 297/259.2 |
| 8,408,654 | B2 | 4/2013 | Jones et al. | |
| 8,459,732 | B2 | 6/2013 | LaPointe et al. | |
| 8,506,009 | B2 | 8/2013 | LaPointe et al. | |
| 8,608,240 | B2 | 12/2013 | Marshall et al. | |
| 8,833,844 | B2 | 9/2014 | LaPointe et al. | |
| 8,845,014 | B2 | 9/2014 | Wong | |
| 9,314,099 | B2 * | 4/2016 | Huang | A47C 1/0355 |
| 9,433,294 | B2 * | 9/2016 | Donovan | A47C 1/0242 |
| 10,021,980 | B2 * | 7/2018 | Lawson | A47C 1/0355 |
| 2001/0044961 | A1 | 11/2001 | Epstein et al. | |
| 2004/0208695 | A1 | 10/2004 | LaPointe | |
| 2004/0256902 | A1 | 12/2004 | LaPointe et al. | |
| 2006/0273631 | A1 * | 12/2006 | White | A47C 1/0355 297/85 L |
| 2008/0217975 | A1 * | 9/2008 | Casteel | A47C 1/0352 297/261.1 |
| 2009/0025142 | A1 | 1/2009 | Grossman et al. | |
| 2010/0237678 | A1 | 9/2010 | Leng | |
| 2011/0175426 | A1 * | 7/2011 | Lawson | A47C 1/0355 297/85 M |
| 2011/0248546 | A1 * | 10/2011 | LaPointe | A47C 1/0355 297/85 M |
| 2012/0096975 | A1 | 4/2012 | Du et al. | |
| 2012/0304380 | A1 | 12/2012 | Jin | |
| 2014/0070585 | A1 | 3/2014 | LaPointe | |
| 2014/0091601 | A1 * | 4/2014 | Breen | A47C 1/0355 297/68 |
| 2015/0033885 | A1 | 2/2015 | Kristen | |
| 2015/0208805 | A1 * | 7/2015 | Griggs, Jr. | A47C 1/03222 297/463.1 |
| 2016/0058195 | A1 | 3/2016 | Huang et al. | |

FOREIGN PATENT DOCUMENTS

| | | | | |
|---|---|---|---|---|
| CN | 203538794 | U | 4/2014 | |
| CN | 103932521 | A | 7/2014 | |
| CN | 203852053 | U | 10/2014 | |
| DE | 4225913 | A1 * | 3/1993 | A47C 1/0355 |
| KR | 1020140058606 | A | 5/2014 | |
| WO | 2007093181 | A1 | 8/2007 | |
| WO | 2008118276 | A1 | 10/2008 | |
| WO | 2010036238 | A1 | 4/2010 | |
| WO | 2015172602 | A1 | 11/2015 | |
| WO | WO-2016014681 | A1 * | 1/2016 | A47C 1/03211 |

OTHER PUBLICATIONS

PCT International Search Report for PCT App. No. PCT/US2018/041079 dated Nov. 6, 2018, 9 pages.

Abstract of KR 10-2014-0058606, La-Z-Boy, Incorporated, p. 1.

* cited by examiner

FRAME STRUCTURE AND ASSEMBLY METHOD FOR MOTION FURNITURE

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

CROSS-REFERENCES TO RELATED APPLICATIONS

Not Applicable.

STATEMENT REGARDING FEDERALLY SPONSORED RESEARCH OR DEVELOPMENT

Not Applicable.

REFERENCE TO SEQUENCE LISTING OR COMPUTER PROGRAM LISTING APPENDIX

Not Applicable.

BACKGROUND

The present disclosure relates generally to furniture and more particularly to motion furniture with opposing side mechanisms.

Conventional motion furniture generally includes a frame having opposing side mechanisms or frames joined together by cross-members that span between the side frames. Each side frame includes a number of rigid linkage members connected at pivoting joints. During use, the side frames may be actuated manually by a user or via an electromechanical drive unit on the frame. When the side frames are actuated, the linkage members pivot and/or translate relative to one another, leading to a desired movement of the furniture. Such desired movements often include rocking, reclining, or raising or lowering a headrest or ottoman.

The side frames in conventional motion furniture are commonly mirror images of each other, and the side frames often move simultaneously in identical ranges of motion. The side frames may be biased in an open or closed position using one or more springs or linkages to position the side frames in a desired position.

During assembly of the frame, each side frame is positioned in a jig or template at a desired orientation and spacing, and frame components such as cross-members, springs and activators are attached to the side frames using any suitable attachment mode, including for example manual fixation of the components to the side frames using fasteners or a mechanical interference fit. Alternatively, during frame assembly, one or more components may be installed using automated industrial robots having suitable end of arm tooling to affix the components to each side frame at the appropriate locations.

During both manual and automated frame assembly for motion furniture, it is generally desirable to reduce the number of physical operations any worker or automated robot must perform to further optimize the throughput and efficiency of the assembly line. One issue with conventional furniture devices is that when assembling one or more cross support members onto the side frames, fasteners such as bolts, screws, rivets, etc. are inserted through the cross support member and into the side frames from a direction that is generally horizontal or parallel with the cross member itself, as shown in FIG. 1. Insertion of the fasteners in such an orientation can be cumbersome as the cross member can interfere with the tooling needed to drive the fastener into the side frame to secure the cross support member to the side frame. This can be particularly true for automated robotic equipment, which can typically include larger tooling which can be more difficult to position into smaller spaces or areas were space and maneuverability are limited. Additionally, having to orient the tooling in the position shown in FIG. 1 to secure conventional cross support members to the side frames can be difficult to program or achieve in automated or robotic assembly equipment. As such, conventional configurations for the connection between one or more cross support members and the side frame of motion furniture can in some instances prevent assembly of the furniture apparatus from being fully automated.

What is needed then are improvements in component devices and methods for frame assembly in motion furniture.

BRIEF SUMMARY

This Brief Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

One aspect of some embodiments of the present disclosure is a frame for motion furniture including a first side frame and a second side frame. A first plurality of connecting flanges extends from the first side frame toward the second side frame, and a second plurality of connecting flanges extends from the second side frame toward the first side frame. A plurality of cross support members span between the first and second side frames in a horizontal direction, each of the cross support members positioned against a corresponding connection flange of the first plurality of connection flanges and against a corresponding connection flange of the second plurality of connection flanges. A plurality of fasteners connects corresponding cross support members to corresponding connection flanges. Each fastener has a longitudinal axis that is oriented in a direction that is transverse to the horizontal direction.

Another aspect of some embodiments of the present disclosure is a furniture apparatus having a first side frame and a second side frame. A first front connecting flange, a first rear connecting flange, and a first middle connecting flange extend from the first side frame toward the second side frame. A front cross support member; a rear cross support member, and middle cross support member each span between the first and second side frames in a horizontal direction. A first front fastener connects the first front connecting flange to the front cross support member. A first rear fastener connects the first rear connecting flange to the rear cross support member. A first middle fastener connects the first middle connecting flange to the middle cross support member. Each of the first front fastener, the first rear fastener, and the first middle fastener extend through the corresponding cross support member and connecting flange in a direction that is transverse to the horizontal direction.

A further aspect of some embodiments of the present disclosure is a method of assembling furniture, including the steps of providing a first side frame and a second side frame, the first side frame having a first plurality of connecting flanges extending from the first side frame toward the second side frame, the second side frame including a second plurality of connecting flanges extending from the second side frame toward the first side frame; positioning a plurality of cross support members between the first side frame and the second side frame in a horizontal direction, each cross support member positioned against a corresponding connecting flange of the first plurality of connecting flanges and against a corresponding connecting flange of the second plurality of connecting flanges; securing each of the plurality of cross support members to the corresponding connecting flanges with one or more corresponding fasteners, each fastener extending through the corresponding cross support member and connecting flange in a direction that is transverse to the horizontal direction.

Numerous other objects, advantages and features of the present disclosure will be readily apparent to those of skill in the art upon a review of the following drawings and description of a preferred embodiment.

DETAILED DESCRIPTION

Figure 1:
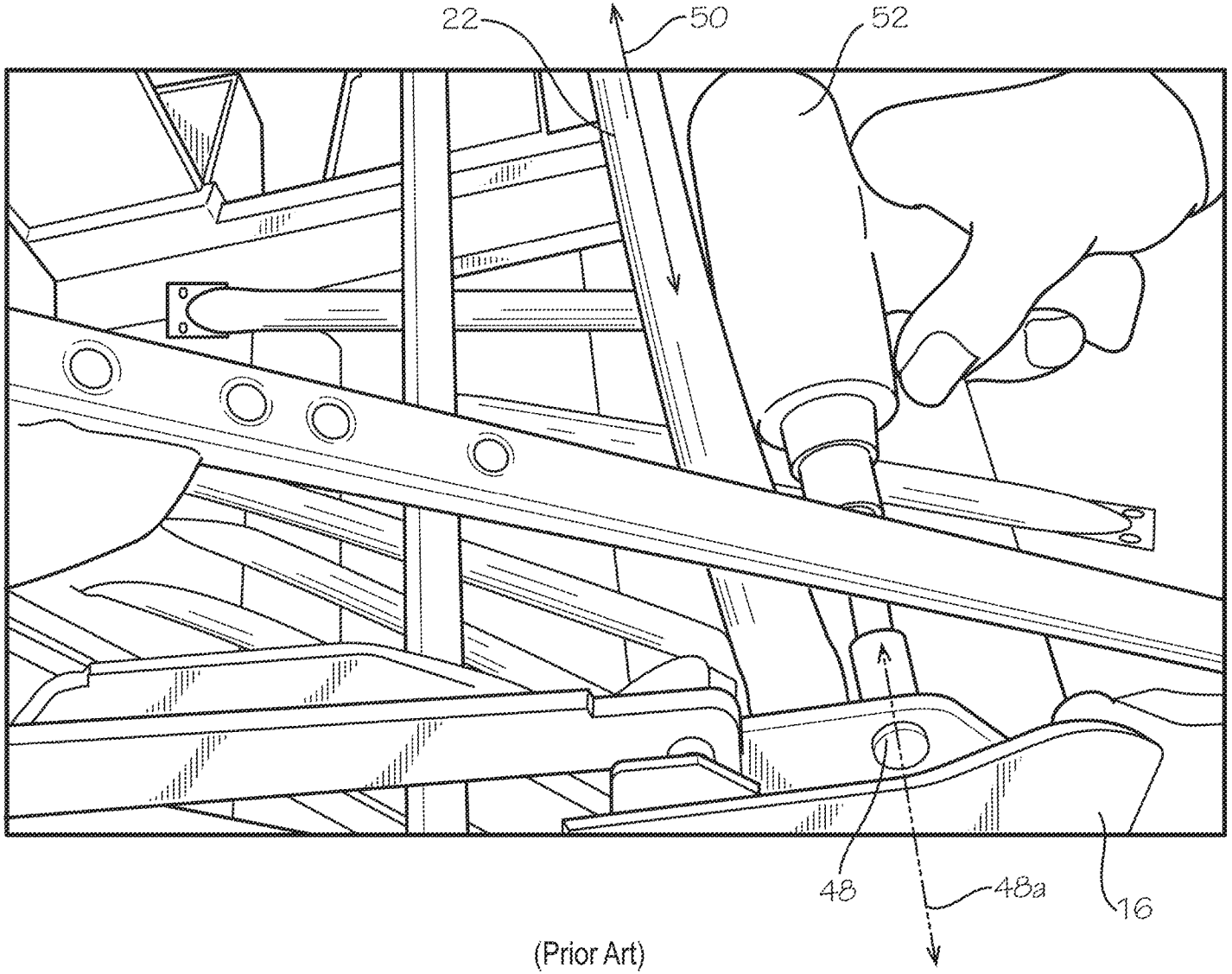
(Prior Art) FIG. 1
FIG. 1 is a perspective detailed view of a conventional cross support member being connected to a side frame of a furniture apparatus.

While the making and using of various embodiments of the present invention are discussed in detail below, it should be appreciated that the present invention provides many applicable inventive concepts that are embodied in a wide variety of specific contexts. The specific embodiments discussed herein are merely illustrative of specific ways to make and use the invention and do not delimit the scope of the invention. Those of ordinary skill in the art will recognize numerous equivalents to the specific apparatus and methods described herein. Such equivalents are considered to be within the scope of this invention and are covered by the claims.

In the drawings, not all reference numbers are included in each drawing, for the sake of clarity. In addition, positional terms such as "upper," "lower," "side," "top," "bottom," etc. refer to the apparatus when in the orientation shown in the drawing, or as otherwise described. A person of skill in the art will recognize that the apparatus can assume different orientations when in use.

Figure 2:
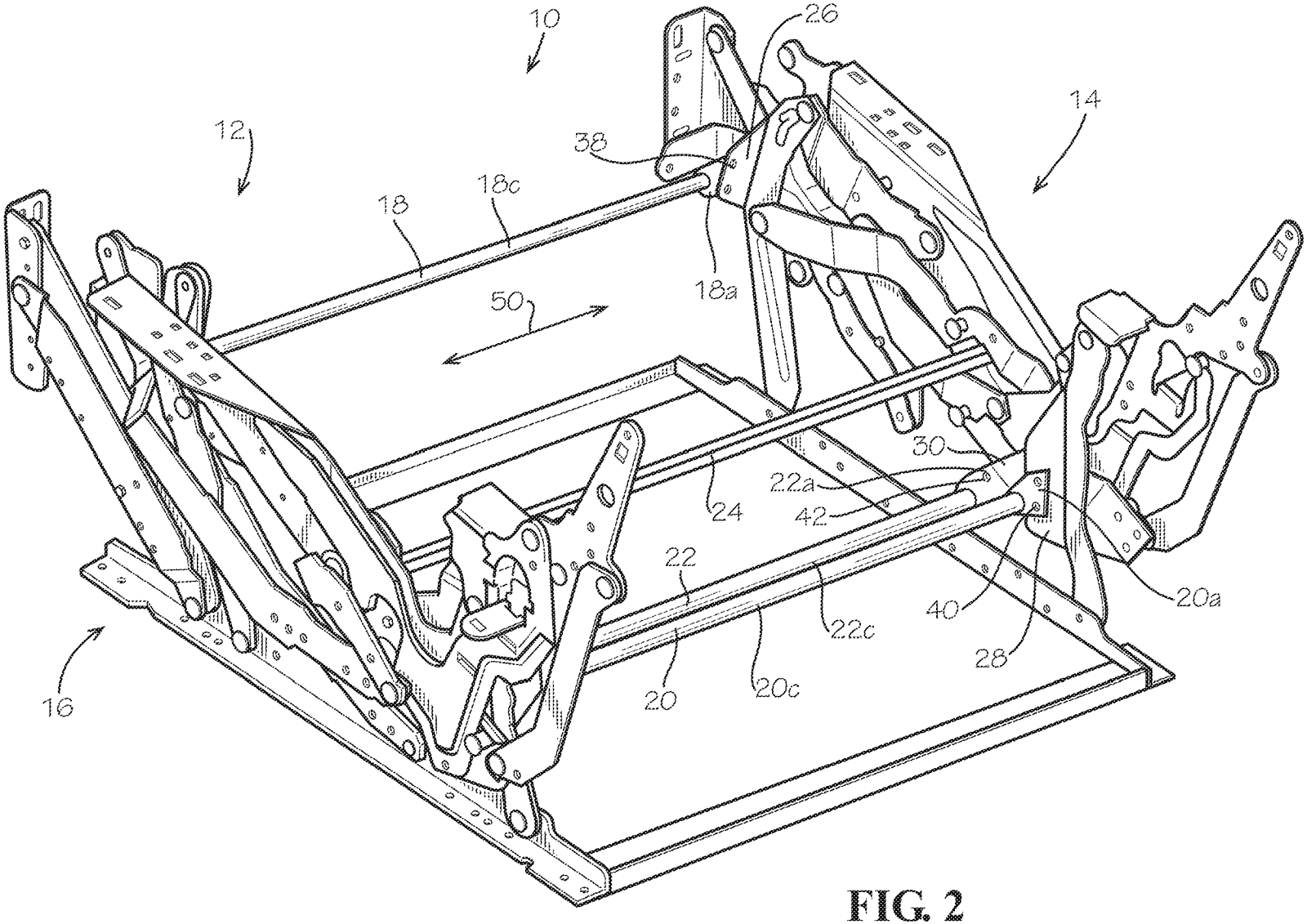
FIG. 2 is a rear perspective view of an embodiment of a furniture apparatus of the present disclosure.
Figure 3:
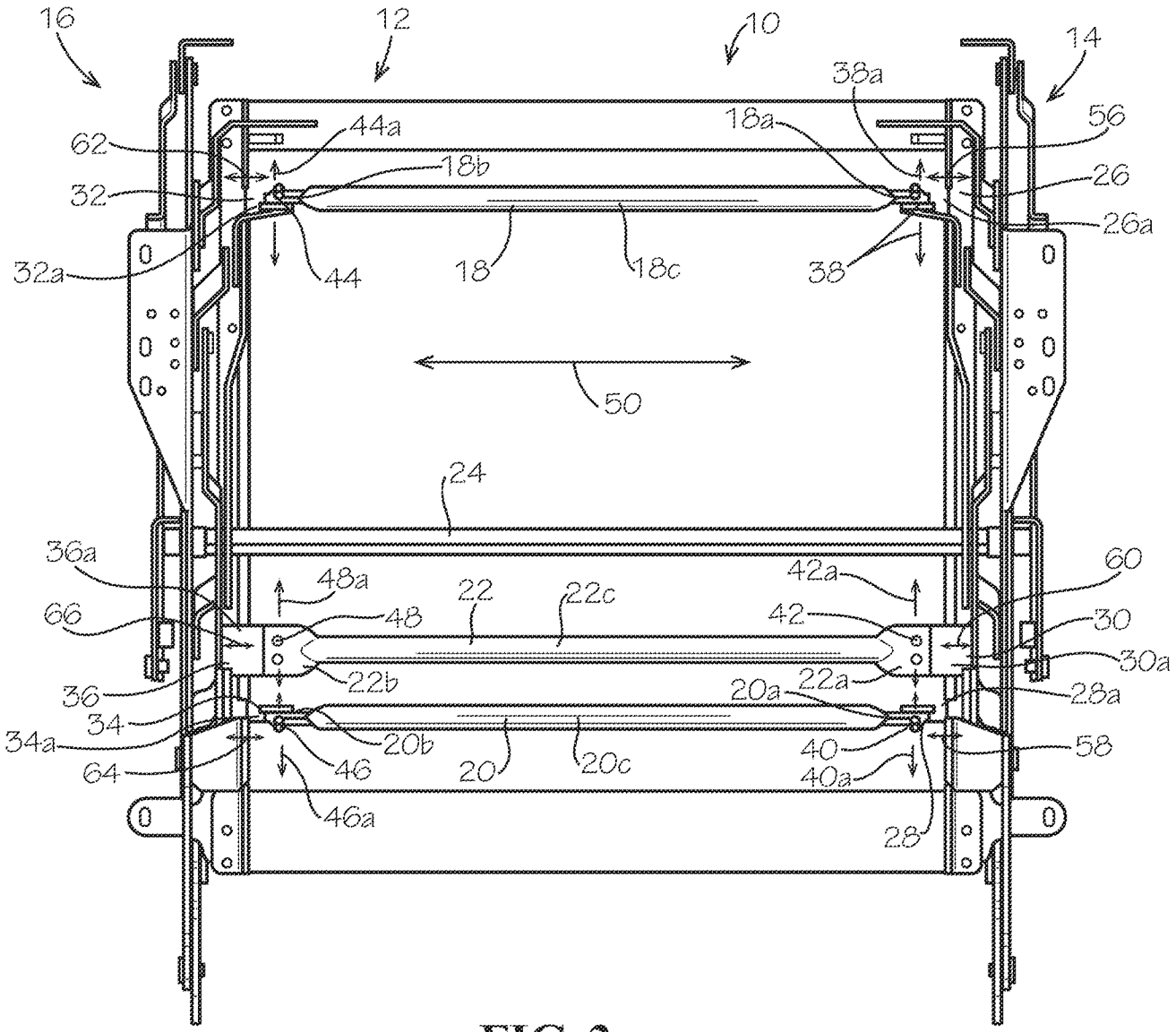
FIG. 3 is a top view of the apparatus of FIG. 2.

Referring now to the drawings, FIGS. 2 and 3 illustrate an embodiment of a furniture apparatus 10 of the present disclosure. Furniture apparatus 10 can include a frame 12 having a first side frame 14 positioned opposite a mirror image second side frame 16, and a plurality of cross support members 18, 20, and 22 and a drive member 24 spanning the gap between the opposing side frames 14 and 16. During assembly, the opposing side frames 14 and 16 are generally aligned and held in place in spaced relation to each other on a jig or template. A worker or an automated robot would then install the horizontal drive member 24 and horizontal cross support members 18, 20, and 22 to connect the opposing side frames 14 and 16 together.

The apparatus 10 can include a first plurality of connecting flanges 26, 28, and 30 extending from first side frame 14 toward second side frame 16. A second plurality of connecting flanges 32, 34, and 36 can extend from second side frame 16 toward first side frame 14. Each of the cross support members 18, 20, and 22 can span between the first and second side frames 14 and 16 in a generally horizontal direction 50 and be positioned against a corresponding connecting flange of the first plurality of connecting flanges 26, 28, and 30, and against a corresponding connecting flange of the second plurality of connecting flanges 32, 34, and 36. As such, each cross support member 18, 20, and 22 can be connected at one end to a connecting flange extending from first side frame 12 and at a second end to a connecting flange extending from second side frame 16 to connect the first and second side frames 14 and 16 together. FIGS. 2 and 3 show three cross support members 18, 20, and 22, and three pairs of corresponding connecting flanges. However, in other embodiments, furniture apparatus 10 could include varying numbers of cross support members and corresponding pairs of connecting flanges. For instance, in some embodiments, furniture apparatus 10 could include 2, 4, 5, 6, etc. cross support members and corresponding pairs of connecting flanges.

In some embodiments, first side frame 14 can include a first front connecting flange 26, a first rear connecting flange 28, and a first middle connecting flange 30. Similarly, second side frame 16 can include a second front connecting flange 32, a second rear connecting flange 34, and a second middle connecting flange 36. Frame 12 and each side frame 14 and 16 can generally include a plurality of frame linkages pivotally connected together such that the frame can move relative to itself to place furniture apparatus 10 in varying extended and/or retracted positions as desired. The various connecting flanges discussed above can connect to, or be integrally formed with, different linkages on frame 12 as desired.

Front cross support member 18 can be positioned against and secured to first front connecting flange 26 and second front connecting flange 32. Rear cross support member 20 can be positioned against and connected to first rear connecting flange 28 and second rear connecting flange 34. Middle cross support member 22 can be positioned against and connected to first middle connecting flange 30 and second middle connecting flange 36. Front and rear cross support members 18 and 20 can be described as balancing members which can help balance and distribute the weight of user on the front and rear of furniture apparatus 10 during use, and middle cross support member 22 can be described as an anti-twisting member which can help prevent twisting of the apparatus during use.

A plurality of fasteners 38, 40, 42, 44, 46, 48 can connect corresponding cross support members to corresponding connection flanges. For instance, in some embodiments, a first front fastener 38 can connect front cross support member 18 to first front connecting flange 26, a first rear fastener 40 can connect rear cross support member 20 to first rear connecting flange 28, and a first middle fastener 42 can connect middle cross support member 22 to first middle connecting flange 30. Similarly, a second front fastener 44 can connect front cross support member 18 to second front connecting flange 32, a second rear fastener 46 can connect rear cross support member 20 to second rear connecting flange 34, and a second middle fastener 48 can connect middle cross support member 22 to second middle connecting flange 36. In some embodiments, pairs of fasteners can be used to connect each end of a cross support member to a corresponding connecting flange.

The plurality of fasteners 38, 40, 42, 44, 46, and 48 can each have a longitudinal axis 38*a*, 40*a*, 42*a*, 44*a*, 46*a*, and 48*a*, respectively, that is oriented in a direction that is transverse to the horizontal direction 50, or in a direction that is not parallel to the horizontal direction 50. The fasteners 38, 40, 42, 44, 46, and 48 can also be described as being oriented transverse to the general direction of extension of the cross support members 18, 20, and 22. Each of the fasteners 38, 40, 42, 44, 46, and 48 thus can extend through the corresponding cross support members and connecting flanges in a direction that is transverse or not parallel to the horizontal direction. As such, as fasteners are used to connect the cross support members to the corresponding connecting flanges, the fasteners can be driven or installed in a direction generally transverse to the cross support members. Varying numbers of fasteners can be used in different embodiments, and each additional fastener used may also have a longitudinal axis oriented in a direction transverse to the horizontal direction 50, or in a direction transverse to the cross support members.

Tooling used to drive the fasteners to connect the cross support members to the connecting flanges therefore can be oriented in a direction generally parallel with the direction of the fasteners, or in a direction transverse to the horizontal direction 50 or the direction of extension of the cross support members. Such an orientation can help reduce interference of the cross support members with the tooling as the fasteners are being driven to secure the cross support members to the connecting flanges. In some embodiments, the longitudinal axis of each fastener can be oriented perpendicular to the horizontal direction 50, such that each fastener can be driven or installed on apparatus 10 in a direction perpendicular to the horizontal direction 50 and the cross support members 18, 20, and 22. In other embodiments, the longitudinal axis of each fastener may be oriented at an acute angle with the horizontal direction, such that tooling used to drive the fasteners to connect the cross support members to the connecting flanges can be oriented at an angle both to the cross support members and to the first and second side frames 14 and 16, to help reduce interference of the tooling with cross support members 18, 20, and 22 as well as first and second side frames 14 and 16.

Figure 8:
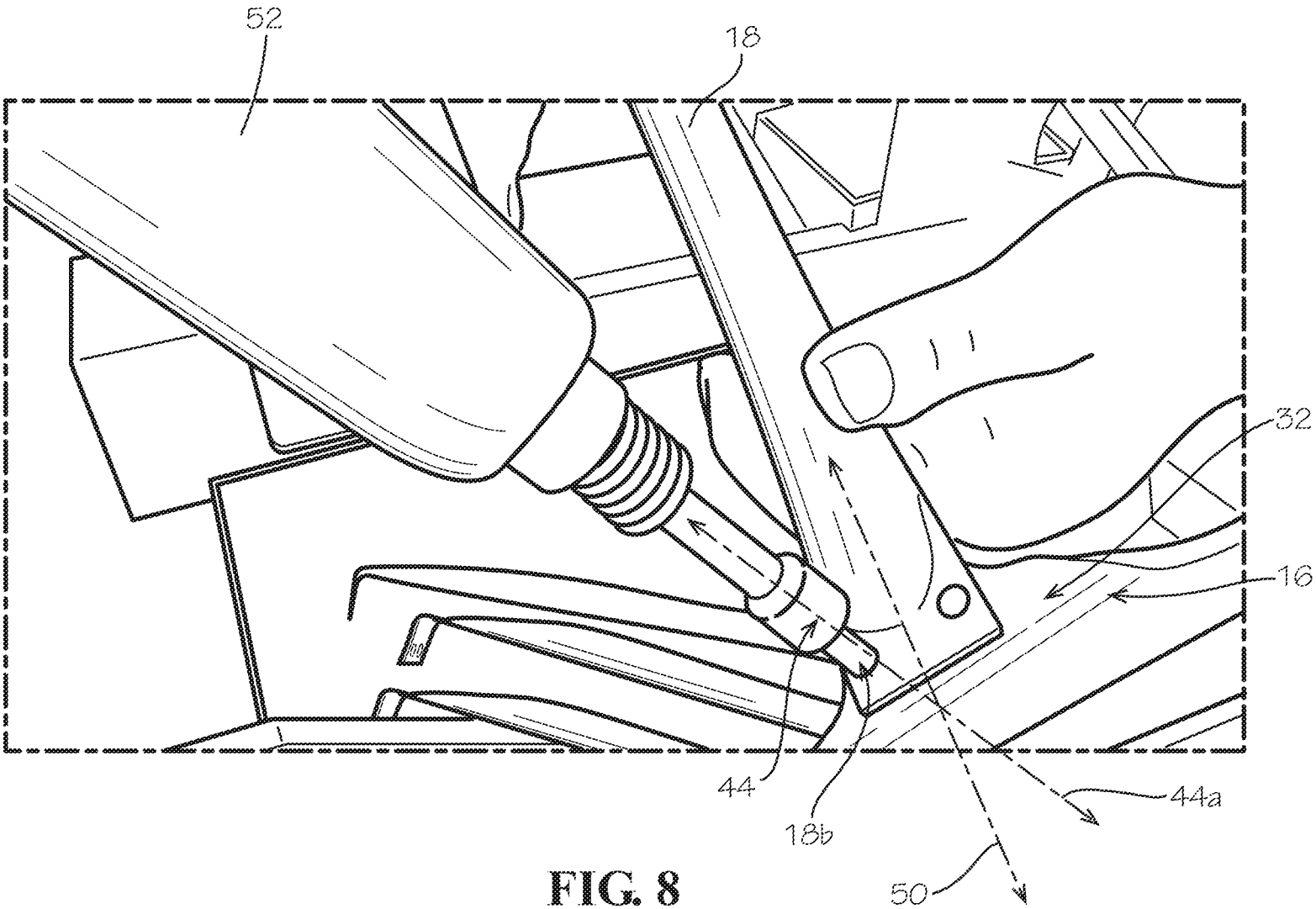
FIG. 8 is a detailed perspective view of a front cross support member being secured to a corresponding connecting flange with a fastener connecting the cross support member to the second side frame oriented at an angle that is transverse to the horizontal direction.

As shown in FIG. 1, in conventional furniture frames where one or more fasteners 48 are oriented parallel to the horizontal direction 50 or parallel with the cross support member 22, the tooling 52 for driving or installing the fastener 48 must also be oriented in a direction parallel with the cross support member 22 which can require the tooling 52 to be placed within the frame itself where space and maneuverability can be limited, and often times portions of the frame can interfere with the range of motion of the tooling or an assembly person's hands. As shown in FIG. 8, having a fastener 44 with a longitudinal axis 44*a* oriented transverse to the horizontal direction 50 and the cross support member 18 can also help remove the need for tooling 52 to be positioned within the interior of frame 12 to drive fastener 44.

Figure 4:
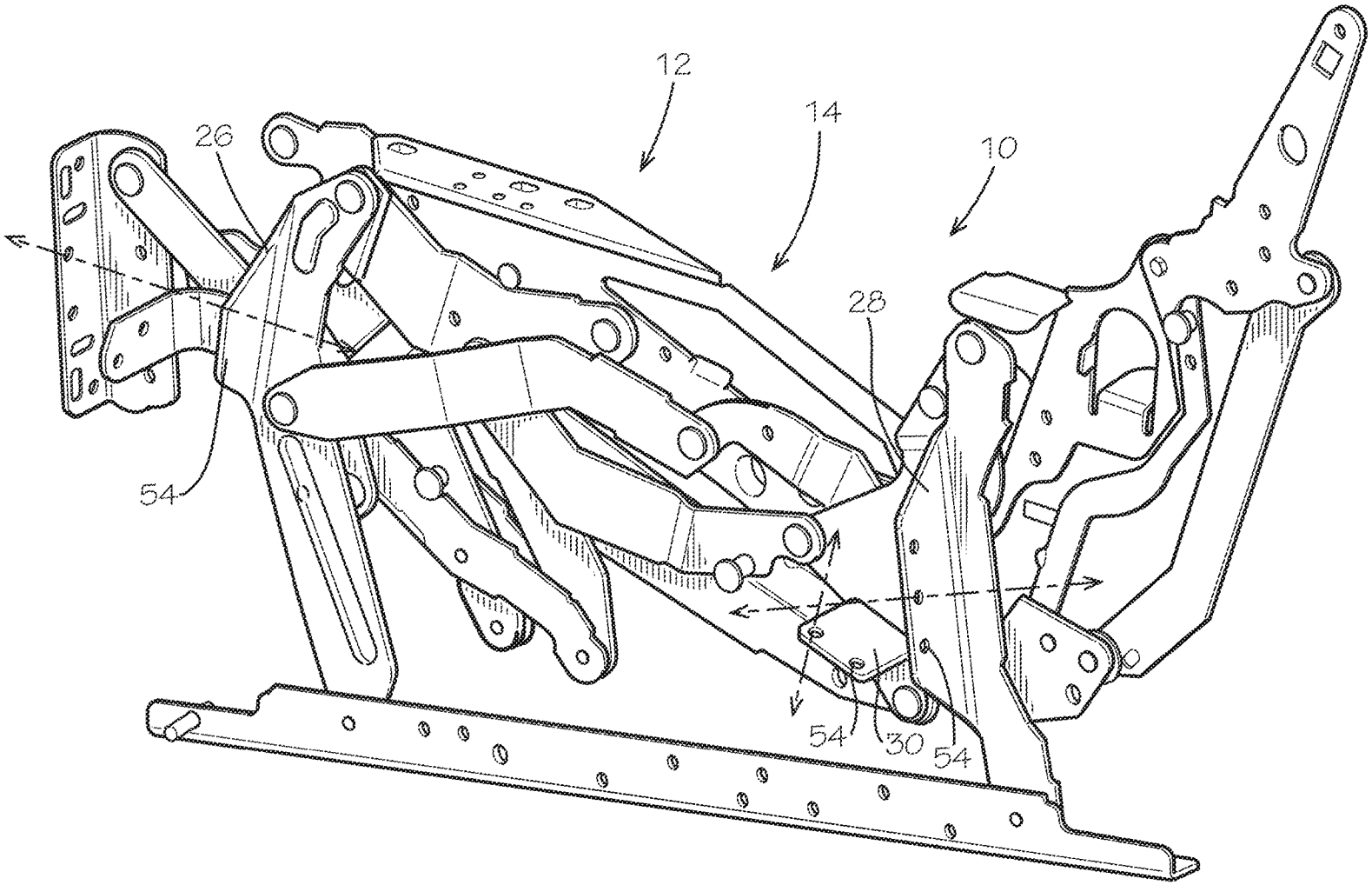
FIG. 4 is a side perspective view of a first side frame of the apparatus of FIG. 2.

As can be seen from FIG. 4, which shows an isolated view of first side frame 14, each of connection flanges 26, 28, 30 includes one or more fastener apertures 54 for receiving a fastener. The fasteners can be any suitable fastener for securing the cross support members to the connecting flanges, including but not limited to bolts, screws, rivets, etc. In some embodiments, the fastener apertures 54 can be threaded sockets which can threadingly engage suitable fasteners. As shown in FIG. 4, each of the fastener apertures 54 can have a central axis that is oriented at an angle or direction transverse to the horizontal direction 50, such that as the fasteners are received in the fastener apertures 54, the fasteners will likewise be oriented in a direction transverse with the horizontal direction 50.

Referring to FIGS. 3-6, in some embodiments, each cross support member 18, 20, and 22 can have a first distal end 18*a*, 20*a*, 22*b* positioned against the corresponding flange of the first plurality of connecting flanges 26, 28, and 30 respectively, a second distal end 18*b*, 20*b*, and 22*b* positioned against the corresponding flange of the second plurality of connecting flanges 32, 34, and 36 respectively, and a middle section 18*c*, 20*c*, and 22*c* spanning the corresponding first and second distal ends. In some embodiments, the first and second distal ends of each of the cross support members 18, 20, and 22 can have the shape of a flat plate extending outward from the middle section in a direction parallel with the horizontal direction 50.

In some embodiments, each of the first plurality of connecting flanges 26, 28, and 30 can extend from first side frame 14 in a direction substantially parallel to the horizontal direction 50, and each of the second plurality of connecting flanges 32, 34, and 36 can extend from second side frame 16 in a direction substantially parallel to the horizontal direction 50. Each of the connection flanges 26, 28, 30, 32, 34, and 36 can include a flat flange plate extending in a direction substantially parallel with the horizontal direction 50. The flat plates of the distal ends of the cross support members 18, 20, and 22 can mate with the corresponding flat flange plates of the connecting flanges 26, 28, 30, 32, 34, and 36. Because the flat plates of the distal ends of the cross support members and the flat flange plates of the connecting flanges both extend in a direction substantially parallel with the horizontal direction, the fasteners that extend through the distal ends of the cross support members 18, 20, and 22 and the corresponding connecting flanges to connect the cross support members to the connecting flanges are oriented transverse to the horizontal direction 50.

Additionally, because the connection flanges include flat flange plates, the flat plates of the distal ends of the cross support members can be mated against and connected to either side of the connecting flanges as desired depending on the orientation of the side frames in the appropriate jig or template. For instance if side frames 14 and 16 are oriented in an upright position as shown in FIG. 2 during assembly, then the distal ends of the cross support members can be connected to an upper side of the connecting flanges, or a side of the connecting flanges that is more accessible from above frame 12. In other embodiments where side frames 14 and 16 are faced downward during assembly, cross support members can be connected to an underside of the connecting flanges, or a side of the connecting flanges that is more accessible from below the frame 12.

Figure 5:
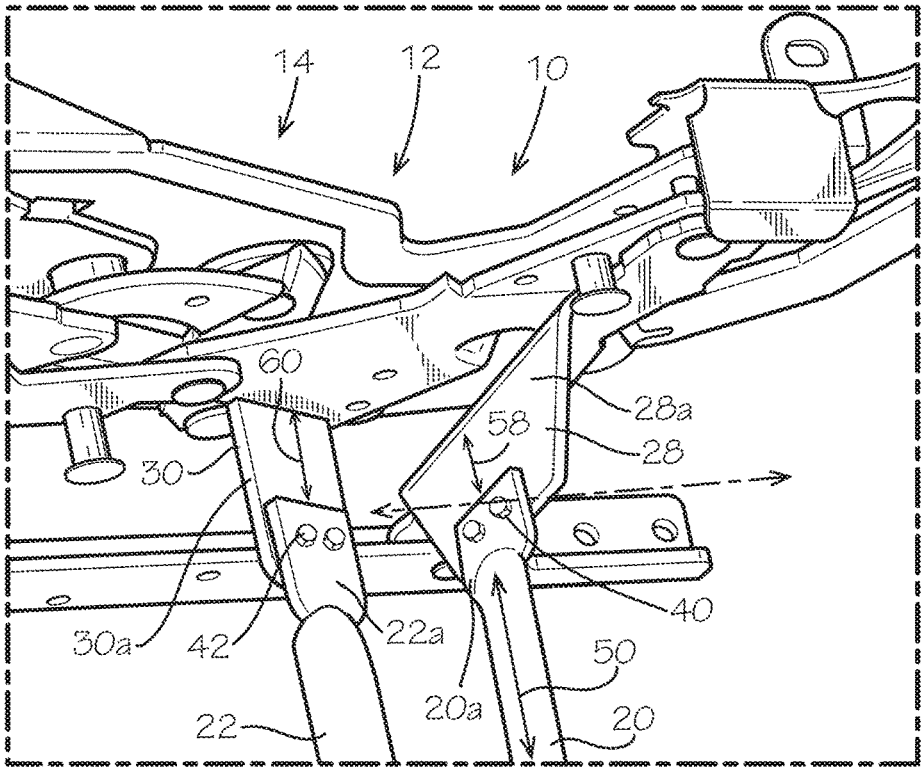
FIG. 5 is a detailed perspective view of the rear and middle cross support members connected to corresponding connecting flanges on the first side frame of FIG. 2.
Figure 6:
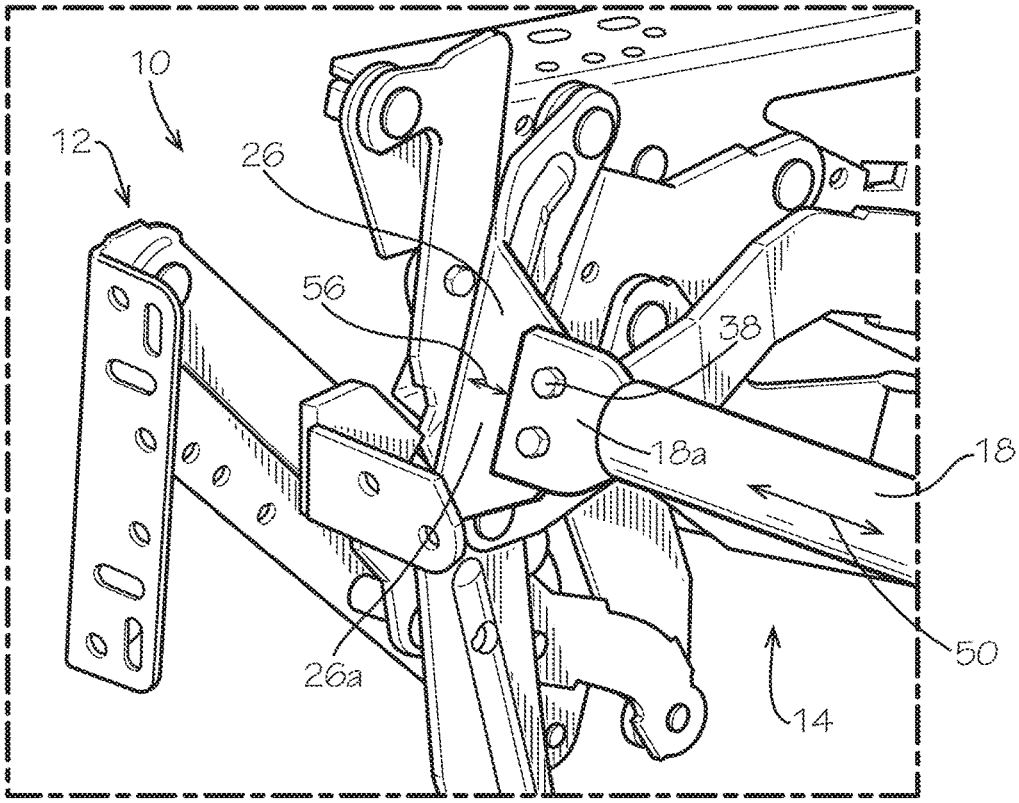
FIG. 6 is a detailed perspective view of the front cross support member connected to a corresponding connecting flange on the first side frame of FIG. 2.

In some embodiments, as shown in FIGS. 5-6, each of the front, rear, and middle cross support members 18, 20, and 22 can form a first side clearance gap 56, 58, and 60 with first side frame 14. Each of first front, first rear, and first middle connecting flanges 26, 28, and 30 can be described as having a spacer portion 26*a*, 28*a*, and 30*a* which is unoccupied by the corresponding cross front, rear, and middle cross support member 18, 20, and 22 respectively. The spacer portions 26*a*, 28*a*, and 30*a* can separate the corresponding cross support members 18, 20, and 22 respectively from the first side frame 14 and thus create the first side clearance gaps 56, 58, and 60 between the cross support members 18, 20, and 22 and first side frame 14.

Having such a clearance or space between first side frame 14 and the cross support members 18, 20, and 22 can help reduce interference between first side frame 14 and cross support members 18, 20, and 22 as the cross support members are positioned between first and second side frames 14 and 16 during assembly and secured to corresponding connecting flanges 26, 28, and 30. Having a gap between cross support members 18, 20, and 22 and first side frame 14 can also position fasteners 38, 40, and 42 at a further distance from first side frame 14, which can help reduce interference between any tooling used to install fasteners 38, 40, and 42 during assembly and first side frame 14.

Referring now to FIGS. 3-6, in some embodiments, each of cross support members 18, 20, and 22 can also from a second side clearance gap 62, 64, and 66 with second side frame 16, with connecting flanges 32, 34, and 36 having similar spacer portions 32*a*, 34*a*, and 36*a*. As such, cross support members 18, 20, and 22 can be spaced from both first side frame 14 and second side frame 16 which can help reduce interference between cross support members 18, 20, and 22 and first and second side frames 14 and 16 during assembly, as well as interference between tooling and first and second side frames 14 and 16 during assembly. Additionally, having cross support members 18, 20, 22 spaced from first and second side frames 14 and 16 can allow cross support members 18, 20 and 22 to be shorter than conventional cross support members for the same size furniture. Shorter, more compact cross support members can be stronger than longer conventional support cross members and also more cost efficient to produce.

Figure 7:
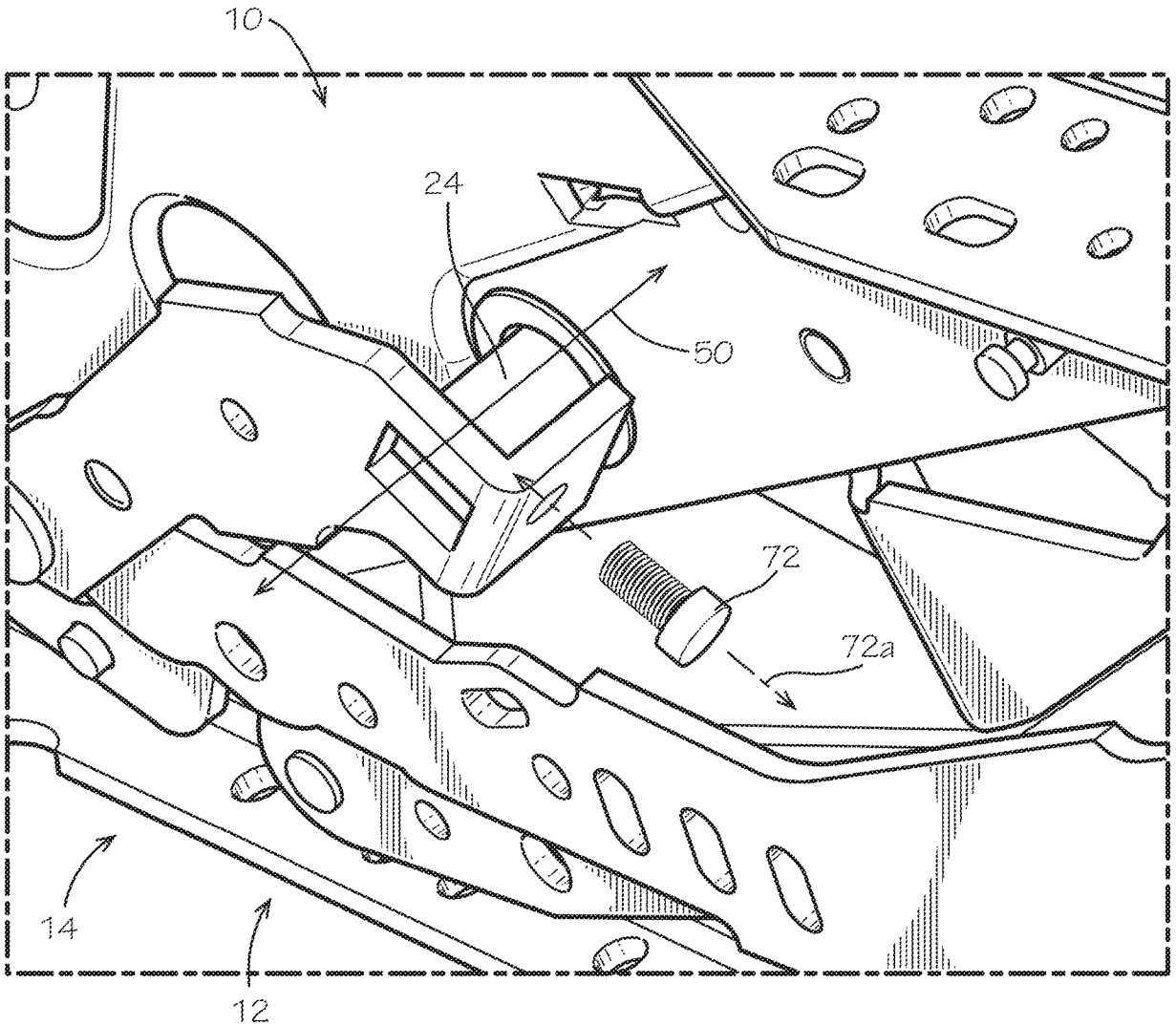
FIG. 7 is a detailed perspective view of a drive member fastener being used to connect a drive member to a side frame of the furniture apparatus of FIG. 2.

In some embodiments, furniture apparatus 10 can include a drive member 24, as shown in FIGS. 2-3. Drive member 24 can span between and extend through the first and second side frames 14 and 16. Drive member 24 can be connected to an actuator linkage on frame 12 and rotated to drive the frame 12 to and from different positions. Drive member fasteners 72 can be used to secure drive member 24 to an exterior actuator portion of first and second side frames 14 and 16, as shown in FIG. 7. In some embodiments, drive member fasteners 72 can include a drive member fastener longitudinal axis 72*a* oriented in a direction transverse to the horizontal direction 50. As such, all fasteners for securing cross support members 18, 20, and 22 to connecting flanges 26, 28, 30, 32, 34, and 36 and all drive member fasteners 72 used to secure drive member 24 to first and second side frames 14 and 16 can be oriented transversely to the horizontal direction 50. As such, all fasteners during assembly of furniture apparatus 10 can be installed with appropriate tooling oriented transversely to the horizontal direction 50 and thus cross bars 18, 20, and 22 and drive member 24, which can help make assembling and installing the fasteners in the appropriate position quicker and more efficient as the likelihood of interference between the tooling and cross support members 18, 20, and 22 and drive member 24 is reduced.

Having a frame structure for the cross support members and the drive member as disclosed herein that allows all of the fasteners to be installed in a direction transverse to the horizontal direction and transverse to the cross support members can make assembly of furniture apparatus 10 more efficient, and can also allow for more ready automation of the entire assembly process, as end of arm tooling on robotic equipment can be more easily positioned to drive the fasteners and drive member fasteners as appropriate. Because all of the fasteners are oriented in a direction transverse to the horizontal direction, the end of arm tooling does not have to switch back and forth between an orientation transverse to the horizontal direction for some fasteners, and an orientation parallel to the horizontal direction for others, which can make automating the assembly process easier and more efficient. Additionally, because the bulk of the tooling does not have to be positioned within the frame or between the first and second side frames, issues related to interference between the tooling and portions of the frame can be reduced.

Figure 9:
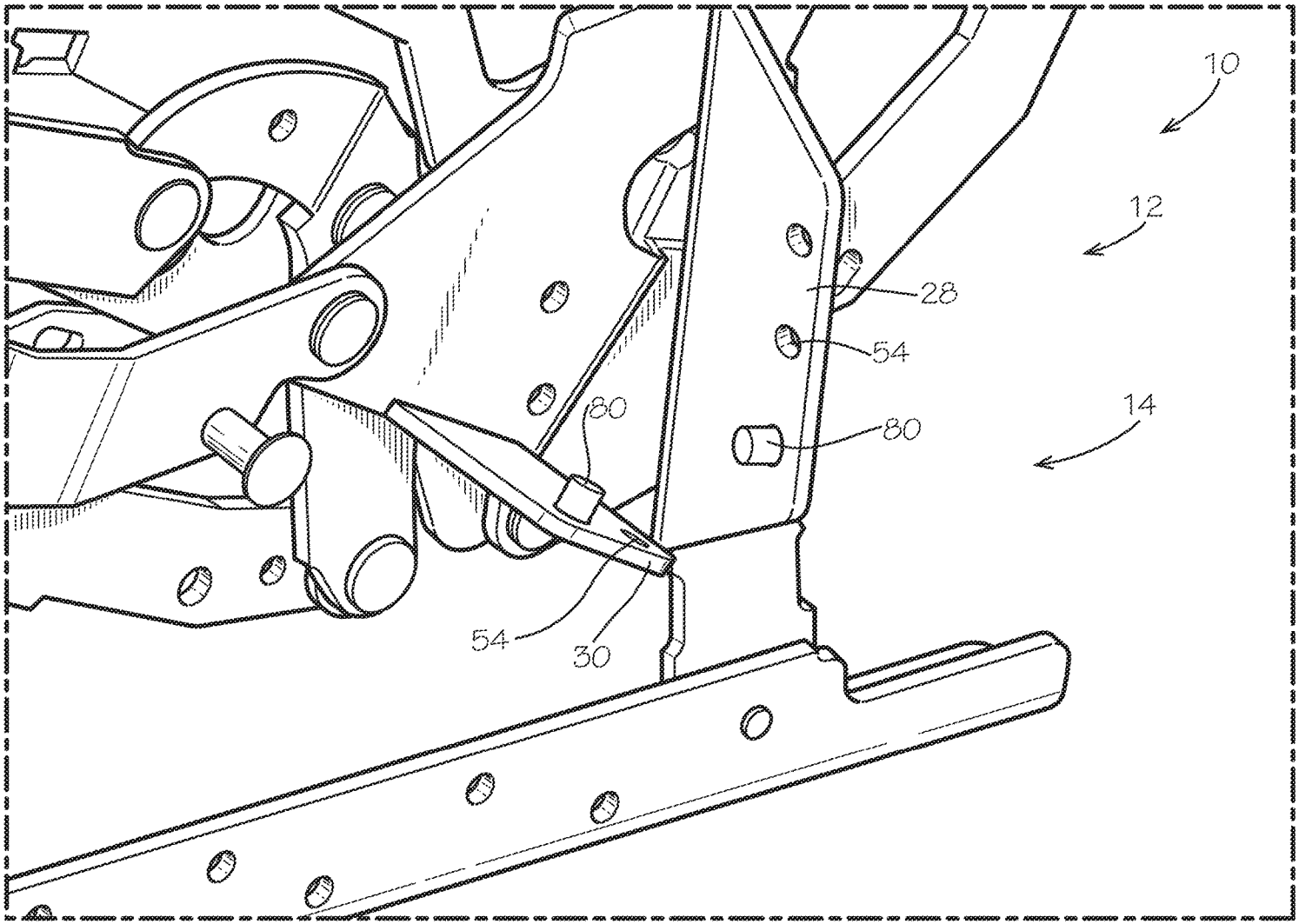
FIG. 9 is a detailed perspective view of another embodiment of a furniture apparatus having connecting flanges with at least one guide post extending from each connecting flange.
Figure 10:
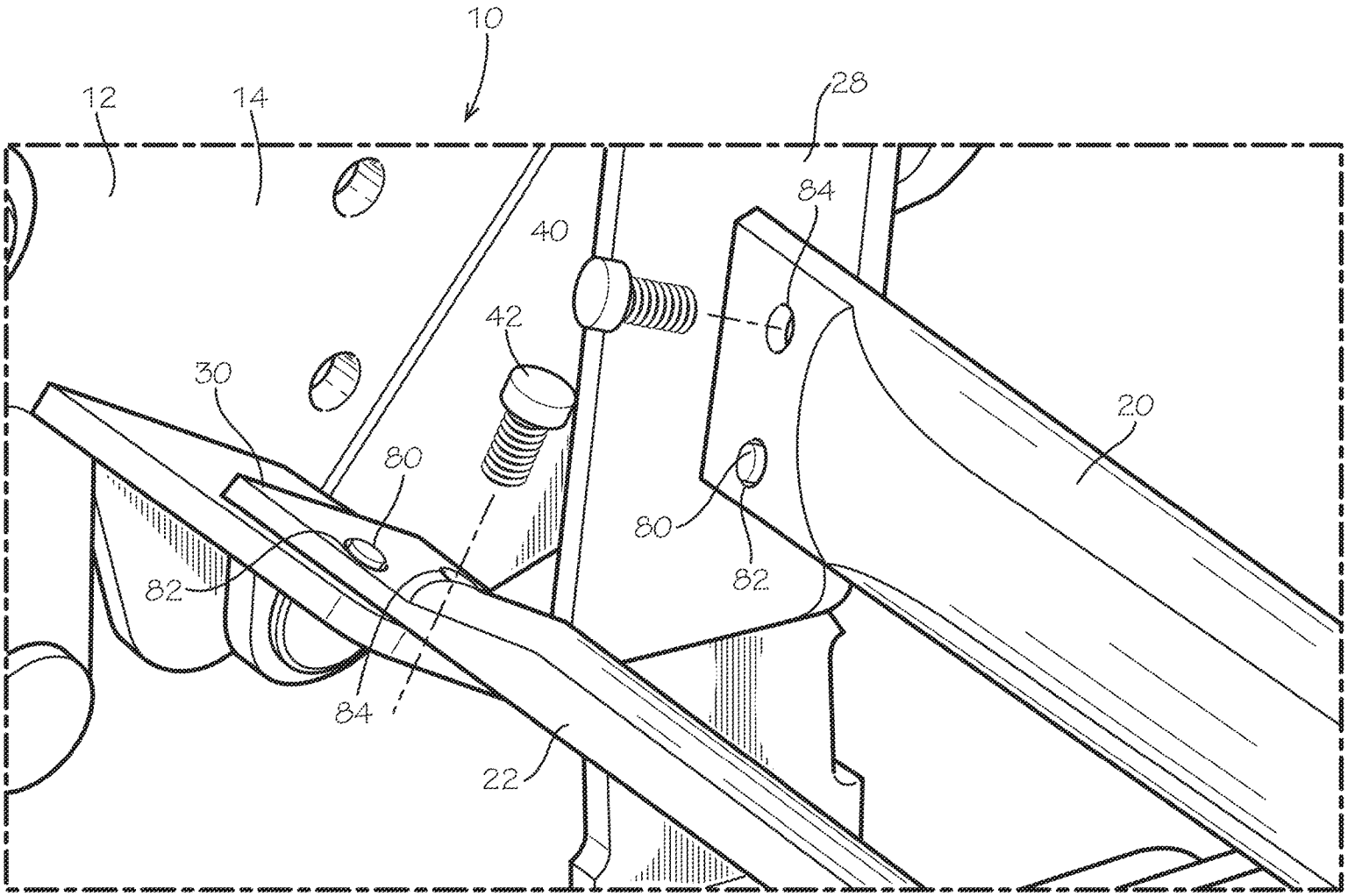
FIG. 10 is a detailed perspective view of a multiple cross support members being positioned on corresponding connecting flanges of FIG. 9 with the guide posts on the corresponding connecting flanges received through apertures in the flat plates of the cross support members to align the cross support members on the connecting flanges.

Another embodiment of a furniture apparatus 10 of the present disclosure is shown in FIGS. 9-10. In some embodiments, the connecting flanges of furniture apparatus 10 can have one or more guide posts 80 extending outward from each of the connecting flanges. Guide posts 80 can be mechanically connected to corresponding connecting flanges in some embodiments, while in other embodiments, the guide posts 80 can be integrally formed with corresponding connecting flanges. In FIGS. 9-10, first rear connecting flange 28 and first middle connecting flange 30 are shown as having guide posts 80, and corresponding rear and middle cross supports 20 and 22 are shown connecting to corresponding flanges 28 and 30. Similar guide posts 80 can be included on the other connecting flanges on furniture apparatus 10, with cross support members engaging with corresponding connecting flanges of furniture apparatus 10 as described below.

Guide posts 80 can be positioned on connecting flanges 28 and 30 to be received in corresponding cross member guide apertures 82 defined in corresponding cross support members 20 and 22, as shown in FIG. 10, such that as corresponding cross support members 20 and 22 are positioned on corresponding connecting flanges 28 and 30, guide posts 80 can be received in the corresponding cross support member guide apertures 82 to position the cross support members 20 and 22 in a desired position on corresponding connecting flanges 28 and 30, with cross member fastener apertures 84 aligned with corresponding fastener apertures 54 on the connecting flanges 28 and 30. A similar process can be performed at the opposite end of the each cross support member 20 and 22 to position and retain each cross support member 20 and 22 on corresponding guide posts 80 in a desired orientation. Corresponding fasteners 40 and 42 can then be extended through the corresponding cross member fastener apertures 84 and fastener apertures 54 on corresponding connecting flanges 28 and 30 to secure the cross support members 20 and 22 to the corresponding connecting flanges 28 and 30. In some embodiments, guide posts 80 can extend perpendicularly from corresponding connecting flanges, and cross support member guide apertures 82 can be defined and oriented in a perpendicular direction through the flat plates of the cross support members. As such, with the connecting flanges and the flat plates of the cross support members oriented parallel to one another, guide posts 80 can readily be received within cross support member guide apertures 82.

In some embodiments, guide posts 80 can be sized such that at least a portion of each guide post 80 extends past corresponding cross support members when the guide posts 80 are received in corresponding cross support member guide apertures 82. In some embodiments, guide posts 80 can be at least partially threaded on the distal ends of the guide posts 80. A threaded nut can threadingly engage each guide post 80 to provide a second attachment point between corresponding cross support members and connecting flanges in addition to the fasteners provided. In other embodiments, guide posts 80 can simply be positioned within cross support member guide apertures 82 without being otherwise secured to a corresponding cross support member.

Guide posts 80 can allow cross support members 20 and 22 to be positioned on corresponding connecting flanges 28 and 30 and retained in a desired orientation during installation of fasteners 40 and 42 without the need for a user to hold the cross support members 20 and 22 in the proper orientation as fasteners 40 and 42 are driven through cross support members 20 and 22 and into connecting flanges 28 and 30 respectively. As such guide posts 80 can free up a user's hand as fasteners 40 and 42 are being installed.

In an automated process, guide posts 80 can allow a robotic end of arm tooling to first position cross support members on corresponding flanges and guide posts at opposite ends of the cross support members to retain the cross support member in a desired orientation between the two side frames, and then the robotic end of arm tooling can install corresponding fasteners through each end of the cross support members and into corresponding connecting flanges to secure the cross support members to each side frame. The installation of the fasteners can thus be achieved by a single robotic arm in sequential steps, as opposed to needing one robotic arm to hold the cross members in a proper orientation and another to install the fasteners. As such, guide posts 80 can help make automation of the assembly of furniture apparatus 10 more efficient.

Another aspect of the present disclosure is a method of assembling furniture, including the steps of providing a first side frame and a second side frame, the first side frame having a first plurality of connecting flanges extending from the first side frame toward the second side frame, the second side frame including a second plurality of connecting flanges extending from the second side frame toward the first side frame; positioning a plurality of cross support members between the first side frame and the second side frame in a horizontal direction, each cross support member positioned against a corresponding connecting flange of the first plurality of connecting flanges and against a corresponding connecting flange of the second plurality of connecting flanges; and securing each of the plurality of cross support members to the corresponding connecting flanges with one or more corresponding fasteners, each fastener extending through the corresponding cross support member and connecting flange in a direction that is transverse to the horizontal direction.

In some embodiments, the positioning step can further include forming a first side clearance gap between each cross support member and the first side frame, and forming a second side clearance gap between each cross support member and the second side frame. In some embodiments, each cross support member includes a first distal end and second distal end, and the positioning step further includes positioning the first distal end of each cross support member against the corresponding connecting flange of the first plurality of connecting flanges, and positioning the second distal end of each cross support member against the corresponding connecting flange of the second plurality of connecting flanges.

In some embodiments, each of the distal ends of the cross support members include a flat plate extending in a direction substantially parallel to the horizontal direction, and each of the connecting flanges includes a flat flange plate extending in a horizontal direction, and the positioning step further includes mating the flat plates of each of the distal ends of the cross support bars with the flat flange plate of the corresponding connecting flange in a flush orientation.

Thus, although there have been described particular embodiments of the present invention of a new and useful Frame Structure and Assembly Method For Motion Furniture, it is not intended that such references to particular embodiments be construed as limitations upon the scope of this invention.

What is claimed is:

1. A furniture apparatus, comprising:

a first side frame;

a second side frame;

a first plurality of connecting flanges extending from the first side frame toward the second side frame;

a second plurality of connecting flanges extending from the second side frame toward the first side frame;

a front cross support member;

a middle cross support member;

a rear cross support member;

each of the front, middle and rear cross support members spanning between the first and second side frames in a horizontal direction, each of the front, middle and rear cross support members positioned against a corresponding connecting flange of the first plurality of connecting flanges and against a corresponding connecting flange of the second plurality of connecting flanges;

each of the first and second plurality of connection flanges having at least one connection flange guide post extending therefrom, and each of the front, middle, and rear cross support members having at least one guide post aperture positioned to receive the corresponding connection flange guide post; and at least one fastener connecting each of the front, middle and rear cross support members to each corresponding connecting flange;

wherein each fastener has a longitudinal axis that is oriented in a direction that is transverse to the horizontal direction, wherein each of the first, second and third cross support members extends between one of the first plurality of connection flanges and one of the second plurality of connection flanges.

2. The apparatus of claim 1, wherein the longitudinal axis of each of the fasteners is oriented at an angle that is perpendicular to the horizontal direction.

3. The apparatus of claim 1, wherein each cross support member includes a first distal end positioned against the corresponding connecting flange of the first plurality of connecting flanges, a second distal end positioned against the corresponding connecting flange of the second plurality of connecting flanges, and a middle section spanning between the first and second distal ends.

4. The apparatus of claim 3, wherein the first and second distal ends of each cross support member has the shape of a flat plate extending outward from the middle section in a direction parallel with the horizontal direction.

5. The apparatus of claim 4, wherein:

each of the first plurality of connecting flanges includes a flat flange plate extending from the first side frame towards the second side frame in a direction parallel to the horizontal direction; and each of the second plurality of connecting flanges includes a flat flange plate extending from the second side frame towards the first side frame in a direction parallel to the horizontal direction.

6. The apparatus of claim 5, wherein the flat plates of the distal ends of the cross support members mate against the flat flange plates of the corresponding connecting flanges.

* * * * *